US010675884B2

(12) United States Patent
Miyamae

(10) Patent No.: US 10,675,884 B2
(45) Date of Patent: Jun. 9, 2020

(54) INK SUPPLYING DEVICE, INKJET RECORDING APPARATUS, AND COMMUNICATION FAULT DETERMINATION METHOD

(71) Applicant: KYOCERA Document Solutions Inc., Osaka (JP)

(72) Inventor: Tsubasa Miyamae, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/388,045

(22) Filed: Apr. 18, 2019

(65) Prior Publication Data

US 2019/0322106 A1 Oct. 24, 2019

(30) Foreign Application Priority Data

Apr. 20, 2018 (JP) ..... 2018-081406

(51) Int. Cl.
*B41J 2/175* (2006.01)
*B41J 29/38* (2006.01)

(52) U.S. Cl.
CPC ..... *B41J 2/17596* (2013.01); *B41J 2/17566* (2013.01); *B41J 29/38* (2013.01)

(58) Field of Classification Search
CPC .... B41J 2/175; B41J 2/17566; B41J 2/17596; B41J 29/38
See application file for complete search history.

(56) References Cited

U.S. PATENT DOCUMENTS

2005/0022595 A1* 2/2005 Eguchi ..... B41J 2/14427 73/304 R
2009/0284572 A1* 11/2009 Katoh ..... B41J 2/14145 347/85
2011/0273506 A1* 11/2011 Katoh ..... B41J 2/175 347/17
2016/0279929 A1* 9/2016 Shinkawa ..... B41J 2/04581

FOREIGN PATENT DOCUMENTS

JP 2002-019155 A 1/2002

* cited by examiner

*Primary Examiner* — Anh T Vo
(74) *Attorney, Agent, or Firm* — Studebaker & Brackett PC

(57) ABSTRACT

An ink supplying device includes a first reservoir, a second reservoir, a pump, a detector, a measuring section, and a determining section. The pump moves ink between the first reservoir and the second reservoir. The detector is provided on the first reservoir and detects the ink in the first reservoir. The measuring section measures a first period and a second period. The determining section determines whether or not the first period and the second period are equal. The first period is a period starting when the detector does not detect the ink and ending when the pump has moved the ink from the first reservoir to the second reservoir. The second period is a period starting when the pump starts moving the ink from the second reservoir to the first reservoir and ending when the detector detects the ink.

6 Claims, 8 Drawing Sheets

INK SUPPLYING DEVICE, INKJET RECORDING APPARATUS, AND COMMUNICATION FAULT DETERMINATION METHOD

INCORPORATION BY REFERENCE

The present application claims priority under 35 U.S.C. § 119 to Japanese Patent Application No. 2018-081406, filed on Apr. 20, 2018. The contents of this application are incorporated herein by reference in their entirety.

BACKGROUND

The present disclosure relates to an ink supplying device, an inkjet recording apparatus, and a communication fault determination method.

An inkjet recording apparatus includes one or more cams which open and close ink tubes provided for one or more ink tanks. The inkjet recording apparatus includes a number of cams corresponding to the number of ink tanks. Each cam has a semicircular shape. A cam is locked to a rotary shaft and can be stopped at any angle position. The cam switches a corresponding ink tube between open and closed states by rotating.

SUMMARY

An ink supplying device according to an aspect of the present disclosure includes a first reservoir, a second reservoir, a pump, a detector, a measuring section, and a determining section. The first reservoir stores ink. The second reservoir also stores the ink. The pump moves the ink between the first reservoir and the second reservoir. The detector is provided on the first reservoir and detects the ink in the first reservoir. The measuring section measures a first period and a second period. The determining section determines whether or not the first period and the second period are equal. The first period is a period starting when the detector does not detect the ink and ending when the pump has moved the ink from the first reservoir to the second reservoir. The second period is a period starting when the pump starts moving the ink from the second reservoir to the first reservoir and ending when the detector detects the ink.

An inkjet recording apparatus according to an aspect of the present disclosure includes the above ink supplying device.

A communication fault determination method according to an aspect of the present disclosure is to be performed by an ink supplying device including a pump and a detector. The communication fault determination method includes measuring and determining. The pump moves ink between a first reservoir and a second reservoir. The detector is provided on the first reservoir and detects the ink in the first reservoir. In the measuring, a first period and a second period are measured. In the determining, whether or not the first period and the second period are equal is determined. The first period is a period starting when the detector does not detect the ink and ending when the pump has moved the ink from the first reservoir to the second reservoir. The second period is a period starting when the pump starts moving the ink from the second reservoir to the first reservoir and ending when the detector detects the ink.

DETAILED DESCRIPTION

Figure 1:
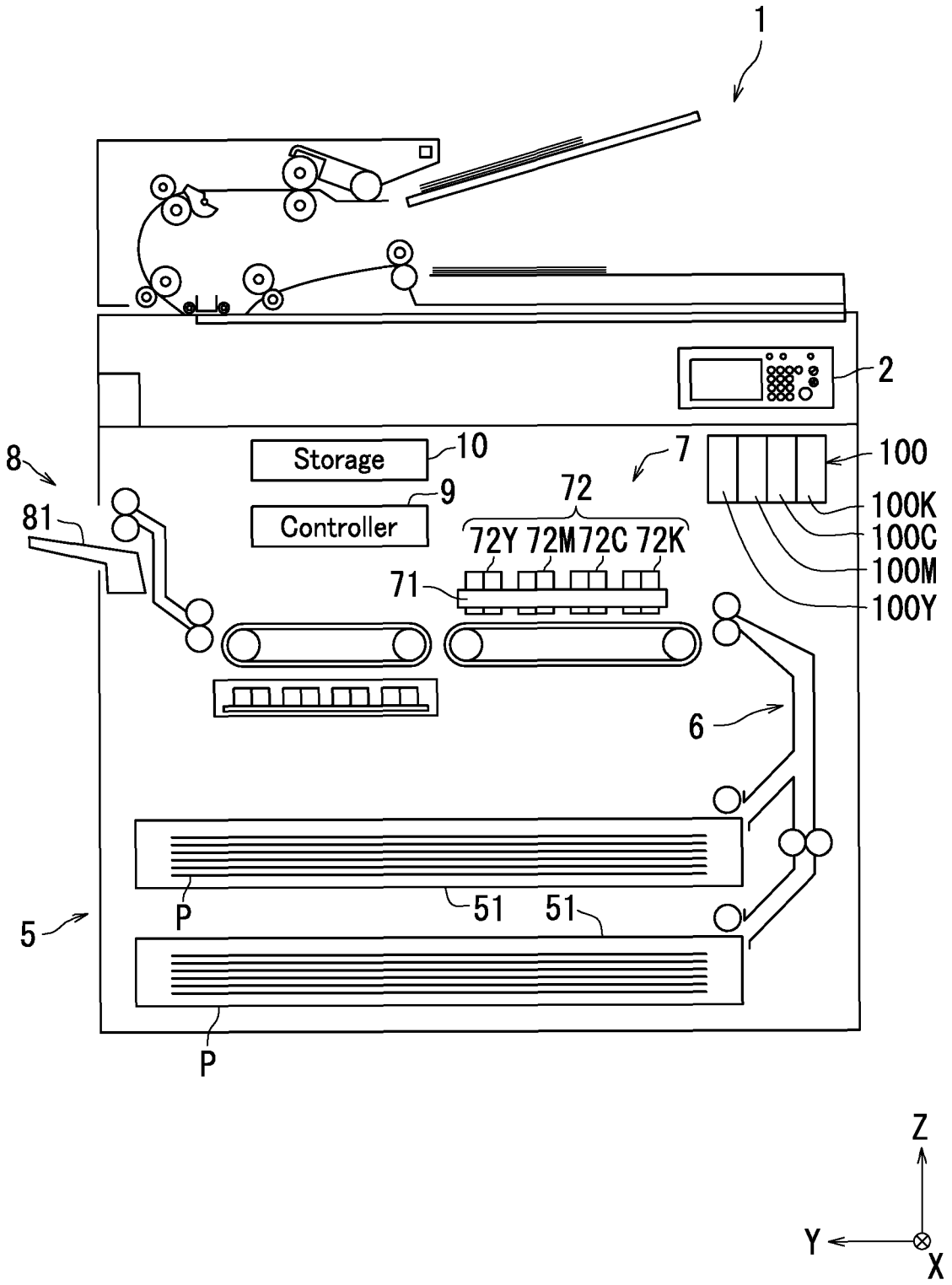
FIG. 1 is a diagram illustrating an inkjet recording apparatus including an ink supplying device according to an embodiment of the present disclosure.

The following describes an embodiment of the present disclosure with reference to the accompanying drawings. Note that elements that are the same or equivalent are labelled with the same reference signs in the drawings and description thereof is not repeated.

The following first describes a configuration of an inkjet recording apparatus 1 with reference to FIG. 1. FIG. 1 is a diagram illustrating the configuration of the inkjet recording apparatus 1 which includes an ink supplying device 100 according to the embodiment of the present disclosure.

As illustrated in FIG. 1, the inkjet recording apparatus 1 includes an operation panel 2, a paper housing section 5, a conveyance unit 6, a recording section 7, the ink supplying device 100, an ejection device 8, a controller 9, and storage 10.

The operation panel 2 receives a job instruction from a user for the inkjet recording apparatus 1. The operation panel 2 includes a notification section and a plurality of operation keys. Upon receiving the instruction from the user, the operation panel 2 transmits a signal indicating the instruction from the user to the controller 9. The notification section includes for example a liquid-crystal display or an organic electroluminescent (EL) display.

The paper housing section 5 includes a plurality of cassettes 51. Specifically, the paper housing section 5 includes a plurality of cassettes 51 which house paper P. The paper P fed from a cassette 51 is conveyed to the conveyance unit 6.

The conveyance unit 6 conveys the paper P so that the paper P passes beneath the recording section 7. The conveyance unit 6 also conveys the paper P to the ejection device 8 after the paper P has passed beneath the recording section 7.

The recording section 7 forms an image on the paper P by ejecting inks. The recording section 7 includes a head housing 71 and four lineheads 72. The head housing 71 supports the four lineheads 72. The four lineheads 72 each eject an ink of a corresponding color.

In the following, a linehead 72 which ejects a yellow ink is referred to as a linehead 72Y. A linehead 72 which ejects a magenta ink is referred to as a linehead 72M. A linehead 72 which ejects a cyan ink is referred to as a linehead 72C. A linehead 72 which ejects a black ink is referred to as a linehead 72K.

The ink supplying device 100 supplies the inks to the recording section 7. The ink supplying device 100 is provided as four devices. A first ink supplying device 100Y supplies the ink to the linehead 72Y. A second ink supplying device 100M supplies the ink to the linehead 72M. A third ink supplying device 100C supplies the ink to the linehead 72C. A fourth ink supplying device 100K supplies the ink to the linehead 72K.

The ejection device 8 includes an exit tray 81. The ejection device 8 ejects the paper P to an exterior of a main body casing. The paper P which is ejected to the exterior of the main body casing is loaded onto the exit tray 81.

The controller 9 includes a processor such as a central processing unit (CPU). The controller 9 controls operation of each section of the inkjet recording apparatus 1 by executing a control program. The controller 9 also includes an integrated circuit for performing an image forming process. The integrated circuit for performing an image forming process includes for example an application-specific integrated circuit (ASIC).

The storage 10 stores data therein. The storage 10 includes a storage device and semiconductor memory. The storage device includes for example either or both a hard disk drive (HDD) and a solid-state drive (SSD). The semiconductor memory includes for example random-access memory (RAM) and read-only memory (ROM). The storage 10 stores the control program therein.

Figure 2:
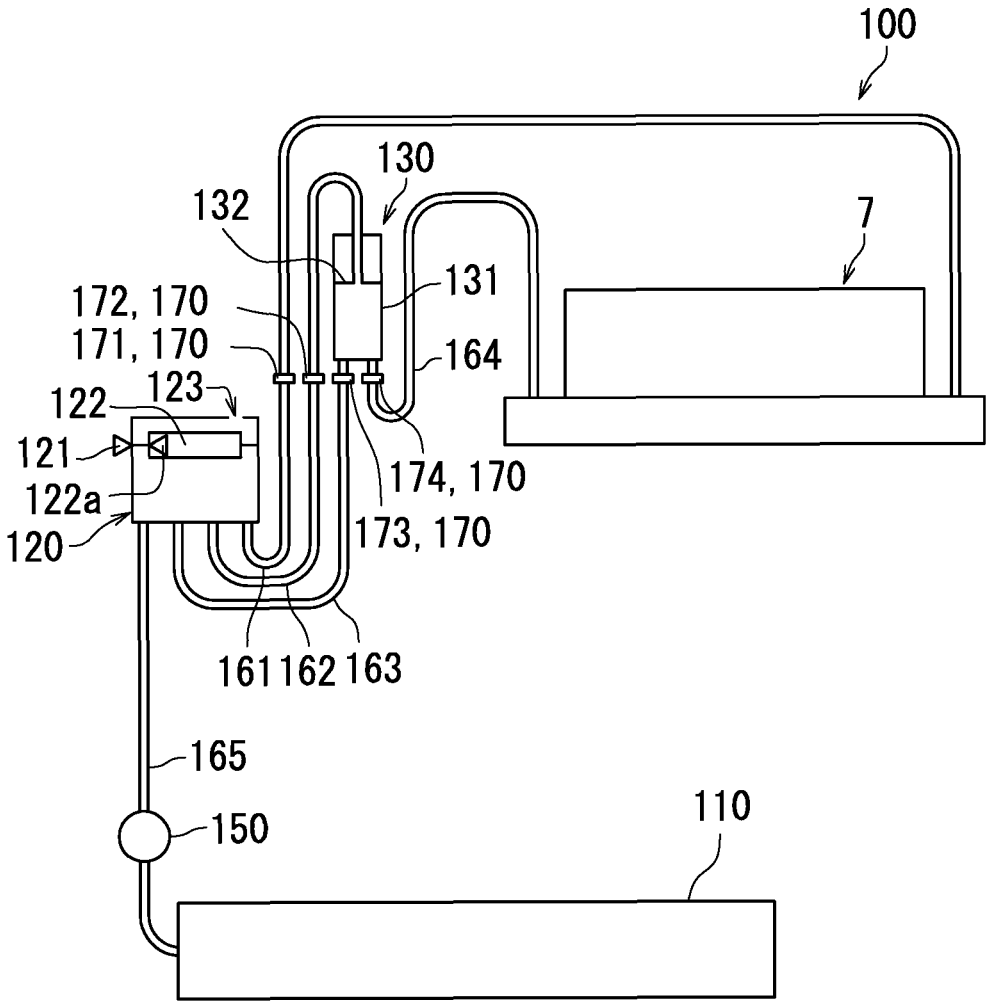
FIG. 2 is a diagram illustrating the ink supplying device according to the embodiment of the present disclosure.

The following describes the ink supplying device 100 in detail with reference to FIG. 2. FIG. 2 is a diagram illustrating the ink supplying device 100. As illustrated in FIG. 2, the ink supplying device 100 includes an ink tank 110, a sub tank 120, a syringe pump 130, a supply pump 150, a plurality of pipes, and a flow channel switching section 170. The ink supplying device 100 operates under the control of the controller 9.

The ink tank 110 stores ink. The ink in the ink tank 110 includes ink to be ejected for recording an image and ink to be ejected for cleaning. The ink tank 110 is provided according to the color of the ink. Specifically, the ink tank 110 is provided as four ink tanks: an ink tank storing the yellow ink, an ink tank storing the magenta ink, an ink tank storing the cyan ink, and an ink tank storing the black ink. Each of the ink tanks 110 is connected to a sub tank 120 of the same ink color through a pipe. The ink tanks 110 are also replaceable when the ink runs out.

The sub tank 120 stores ink. The sub tank 120 is equivalent to an example of a "first reservoir". The sub tank 120 stores ink supplied from the ink tank 110. The sub tank 120 is provided according to the color of the ink. The sub tank 120 is connected to the syringe pump 130 for the same ink color through a pipe. The sub tank 120 includes a float 122 and a detector 121. The detector 121 is a "Hall effect sensor", for example. The float 122 rises and falls inside the sub tank 120 along with rising and falling of the liquid surface of ink inside the sub tank 120. The float 122 includes a magnet holder and a magnet 122*a*. The magnet holder holds the magnet 122*a*. The magnet 122*a* produces a magnetic field. The sub tank 120 also includes a through hole 123. The through hole 123 allows air to pass through. The through hole 123 is located above the liquid surface of ink inside the sub tank 120.

The detector 121 detects the presence or absence of ink inside the sub tank 120. The detector 121 is provided on an outer wall of the sub tank 120. The detector 121 is provided at a specific height on the outer wall of the sub tank 120. The detector 121 is switched between ON and OFF by the magnetic field of the magnet 122*a*. The detector 121 is in an ON state while the detector 121 is detecting the magnetic field of the magnet 122*a*. The detector 121 is in an OFF state while the detector 121 is not detecting the magnetic field of the magnet 122*a*.

The detector 121 outputs a signal to the controller 9 when the magnetic field of the magnet 122*a* is detected. Specifically, the detector 121 detects the magnetic field of the magnet 122*a* and outputs a signal to the controller 9 when ink is supplied to the sub tank 120 and the magnet 122*a* of the float 122 rises to a height at which the detector 121 is provided. As a result, the detector 121 can detect that ink is present inside the sub tank 120.

The detector 121 does not output a signal to the controller 9 when the magnetic field of the magnet 122*a* is not detected. Specifically, the detector 121 does not detect the magnetic field of the magnet 122*a* and does not output a signal to the controller 9 when ink is sent out from the sub tank 120 by the syringe pump 130 and the magnet 122*a* of the float 122 falls below the height at which the detector 121 is provided. As a result, the detector 121 can detect that ink is absent inside the sub tank 120.

The syringe pump 130 sends ink. The syringe pump 130 also ejects ink. The syringe pump 130 includes a cylinder 131 and a piston 132. The syringe pump 130 moves ink between the sub tank 120 and the cylinder 131. Specifically, the syringe pump 130 moves ink between the sub tank 120 and the cylinder 131 through at least one pipe among the plurality of pipes. The syringe pump 130 is provided according to the color of the ink. The syringe pump 130 is connected to a linehead 72 of the same ink color through a pipe. The syringe pump 130 is equivalent to an example of a "pump".

The cylinder 131 stores ink from the sub tank 120. The cylinder 131 is equivalent to an example of a "second reservoir". The cylinder 131 includes a cylindrical portion, a cap portion, and a base portion. The cap portion of the cylinder 131 includes a discharge port through which ink flows in or out. The base portion of the cylinder 131 includes a plurality of discharge ports through which ink flows in or out.

The piston 132 moves inside the cylinder 131. The piston 132 is cylindrically shaped. A portion of the piston 132 is inserted into the cylinder 131. The piston 132 moves from the base portion to the cap portion of the cylinder 131 under the control of the controller 9.

The piston 132 causes ink to flow into the cylinder 131 by moving from the base portion toward the cap portion of the cylinder 131. A direction toward the cap portion is a direction in which the piston 132 separates from the base portion of the cylinder 131. Ink is also caused to flow out of the cylinder 131 by the piston 132 moving from the cap portion toward the base portion of the cylinder 131. A direction toward the base portion is a direction in which the piston 132 approaches the base portion of the cylinder 131.

The supply pump 150 supplies ink stored in the ink tank 110 to the sub tank 120. The supply pump 150 is provided according to the color of the ink. The supply pump 150 supplies ink under the control of the controller 9 until the detector 121 switches ON.

The plurality of pipes includes a first pipe 161, a second pipe 162, a third pipe 163, a fourth pipe 164, and a fifth pipe 165.

The first pipe 161 connects the sub tank 120 to the recording section 7. The second pipe 162 connects the sub tank 120 to the syringe pump 130. The third pipe 163 connects the sub tank 120 to the syringe pump 130. The fourth pipe 164 connects the syringe pump 130 to the recording section 7. The fifth pipe 165 connects the ink tank 110 to the sub tank 120. The supply pump 150 is located on the fifth pipe 165. The first pipe 161, the second pipe 162, the third pipe 163, the fourth pipe 164, and the fifth pipe 165 are equivalent to an example of a "pipe". The first pipe 161, the second pipe 162, the third pipe 163, the fourth pipe 164, and the fifth pipe 165 are flexible. As such, the pipes bend in the direction in which pressure is applied when pressure is applied to the pipes.

The flow channel switching section 170 changes an ink movement destination. Specifically, the flow channel switching section 170 opens and closes the first pipe 161, the second pipe 162, the third pipe 163, and the fourth pipe 164, thus changing the ink movement destination. For example, the flow channel switching section 170 switches the first pipe 161, the second pipe 162, and the fourth pipe 164 from open to closed independently from one another. The flow channel switching section 170 also switches the third pipe 163 from closed to open.

The flow channel switching section 170 includes a rotary shaft, a driving section, and open-close members. The rotary shaft rotates around an axis thereof. The rotary shaft locks the open-close members. The driving section transmits driving force to the rotary shaft. The driving section transmits driving force to the rotary shaft under the control of the controller 9.

An open-close member opens and closes a pipe. The open-close member is a cam, for example. The open-close member has an edge which pushes on the pipe and an edge which does not push on the pipe. The open-close member rotates along with the rotation of the rotary shaft. The open-close member switches between a state of pushing on the pipe and a state of not pushing on the pipe by rotating. The open-close member closes the pipe by pushing on the pipe. The open-close member prevents ink from moving by closing the pipe. The open-close member also opens the pipe by not pushing on the pipe. The open-close member allows ink to move by opening the pipe.

The open-close members include a first open-close member 171, a second open-close member 172, a third open-close member 173, and a fourth open-close member 174. The first open-close member 171 opens and closes the first pipe 161. The second open-close member 172 opens and closes the second pipe 162. The third open-close member 173 opens and closes the third pipe 163. The fourth open-close member 174 opens and closes the fourth pipe 164.

The first open-close member 171, the second open-close member 172, the third open-close member 173, and the fourth open-close member 174 vary according to an angle at which the respective open-close members are locked around the axis of the rotary shaft. For example, the edge of the second open-close member 172 which pushes on the second pipe 162 is in a position offset by 90° from the edge of the first open-close member 171 which pushes on the first pipe 161. As a result, the second open-close member 172 can close the second pipe 162 while the first open-close member 171 opens the first pipe 161 through the rotation of the rotary shaft. The second open-close member 172 can also open the second pipe 162 while the first open-close member 171 closes the first pipe 161 through the rotation of the rotary shaft.

The four open-close members which vary according to the angle at which the respective open-close members are locked to the rotary shaft allow, through the rotation of the rotary shaft, any one of the first open-close member 171, the second open-close member 172, the third open-close member 173, and the fourth open-close member 174 to be in a state of not pushing on a pipe. For example, only the first open-close member 171 of the first open-close member 171, the second open-close member 172, the third open-close member 173, and the fourth open-close member 174 can be in a state of not pushing on the pipe. When only the first open-close member 171 does not push on the pipe, the second open-close member 172, the third open-close member 173, and the fourth open-close member 174 push on the pipes. Note it is also possible to switch a flow channel by using a solenoid valve or the like in each pipe.

Figure 3:
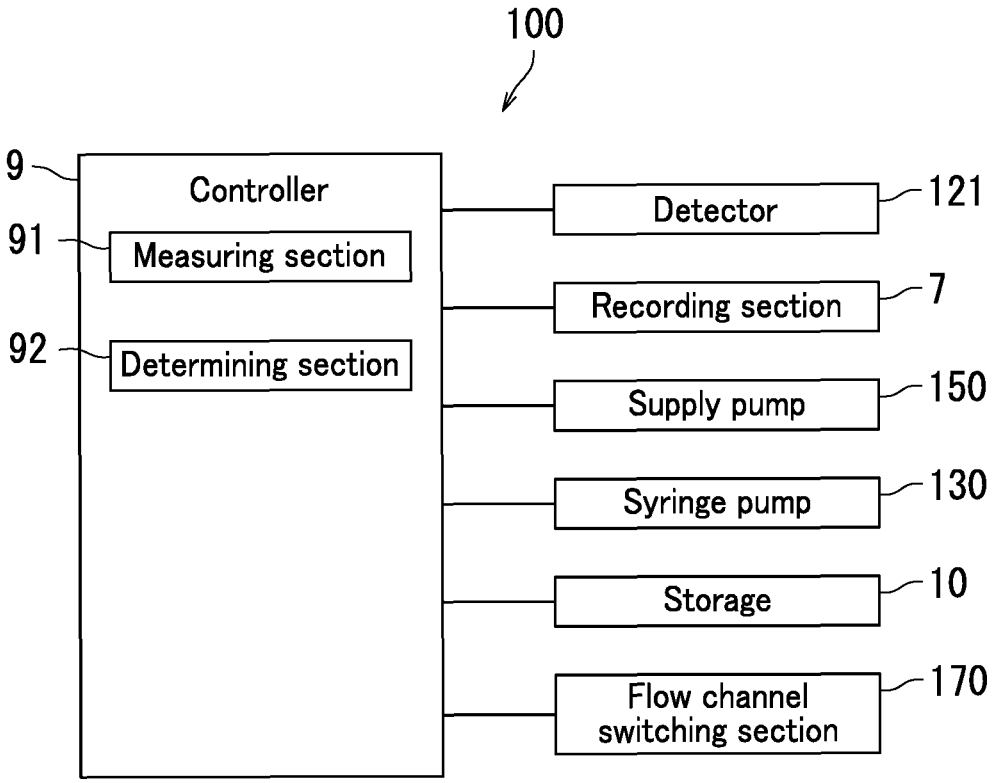
FIG. 3 is a control block diagram of the ink supplying device.

The following describes the controller 9 according to the embodiment of the present disclosure with reference to FIG. 3. FIG. 3 is a control block diagram of the ink supplying device 100. As illustrated in FIG. 3, the controller 9 is linked to the recording section 7, the storage 10, the detector 121, the syringe pump 130, the supply pump 150, and the flow channel switching section 170. As illustrated in FIG. 3, the controller 9 includes a measuring section 91 and a determining section 92. Specifically, the processor of the controller 9 functions as the measuring section 91 and the determining section 92 by executing a computer program stored in the storage device of the storage 10.

The measuring section 91 measures a period starting when the detector 121 is ON and ending when the detector 121 is OFF, and a period starting when the detector 121 is OFF and ending when the detector 121 is ON. The measuring section 91 also measures a period starting when the detector 121 does not detect ink after having detected ink and ending when the syringe pump 130 has moved ink from the sub tank 120 to the cylinder 131 through a specific pipe. The measuring section 91 also measures a period starting when the syringe pump 130 starts moving ink from the cylinder 131 to the sub tank 120 through the specific pipe and ending when the detector 121 detects ink. The specific pipe is a pipe that is open. While the measuring section 91 is measuring a period, the supply of ink from the ink tank 110 to the sub tank 120 is stopped.

The period starting when the detector 121 does not detect ink and ending when the syringe pump 130 has moved ink from the sub tank 120 to the cylinder 131 is equivalent to an example of a first period. The period starting when the syringe pump 130 starts moving ink from the cylinder 131 to the sub tank 120 and ending when the detector 121 switches ON is equivalent to an example of a second period. The first and second periods measured by the measuring section 91 are stored in the storage 10.

The determining section 92 determines whether or not the first and second periods are equal. When the first and second periods are equal, there is no communication fault in the ink supplying device 100. Thus, a communication fault in the ink supplying device 100 can be detected. In particular, a communication fault in the ink supplying device 100 that cannot be discovered visually can be detected. When there is no communication fault in the ink supplying device 100, the controller 9 can determine that the first open-close member 171, the second open-close member 172, the third open-close member 173, and the fourth open-close member 174 are pushing on the respective pipes at positions where ink does not leak. When there is a communication fault in the ink supplying device 100, the controller 9 can determine that the first open-close member 171, the second open-close member 172, the third open-close member 173, and the fourth open-close member 174 are pushing on the respective pipes at positions where ink does leak.

Figure 4:
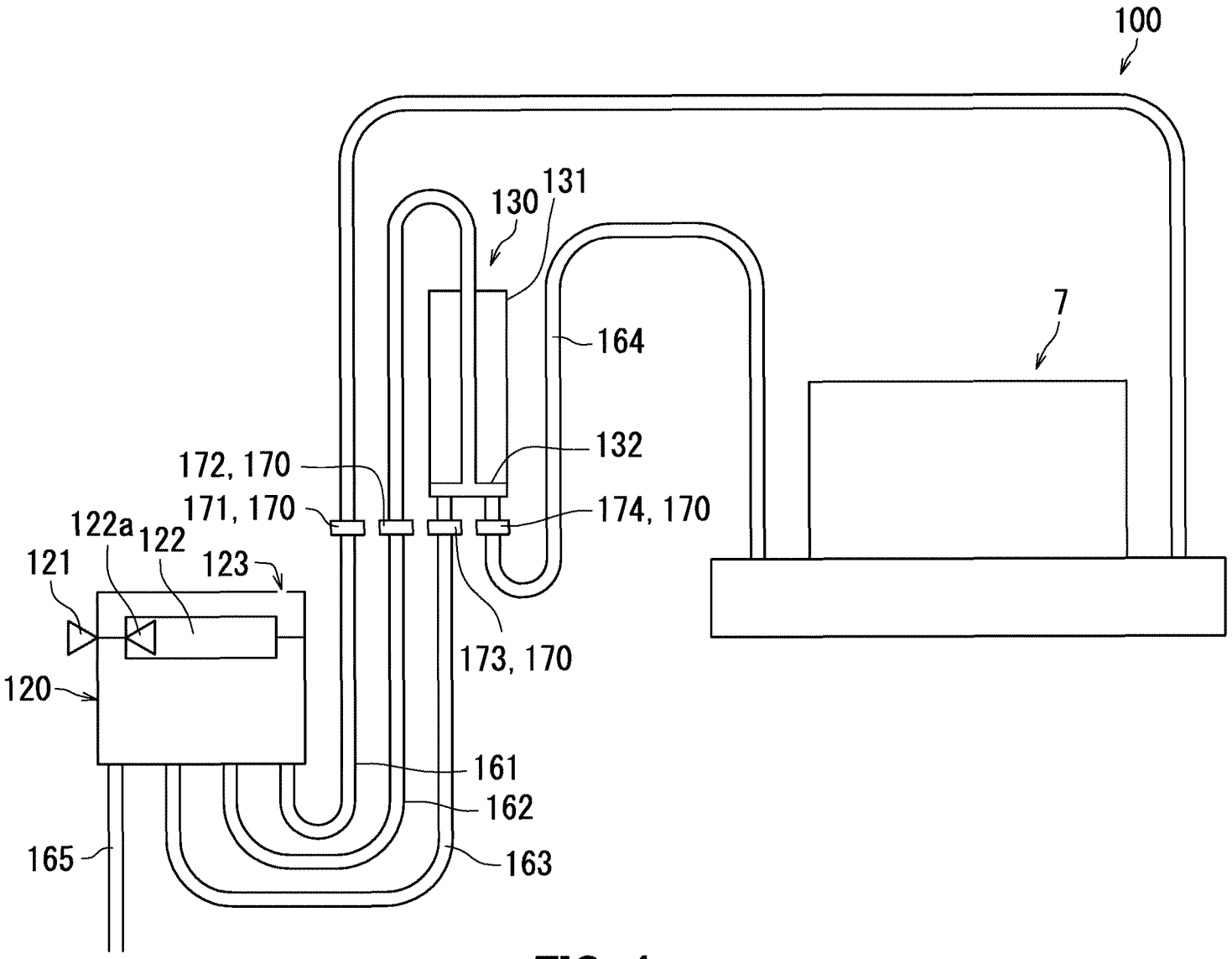
FIG. 4 is a diagram in which a piston of a syringe pump has been moved toward a base portion.
Figure 5:
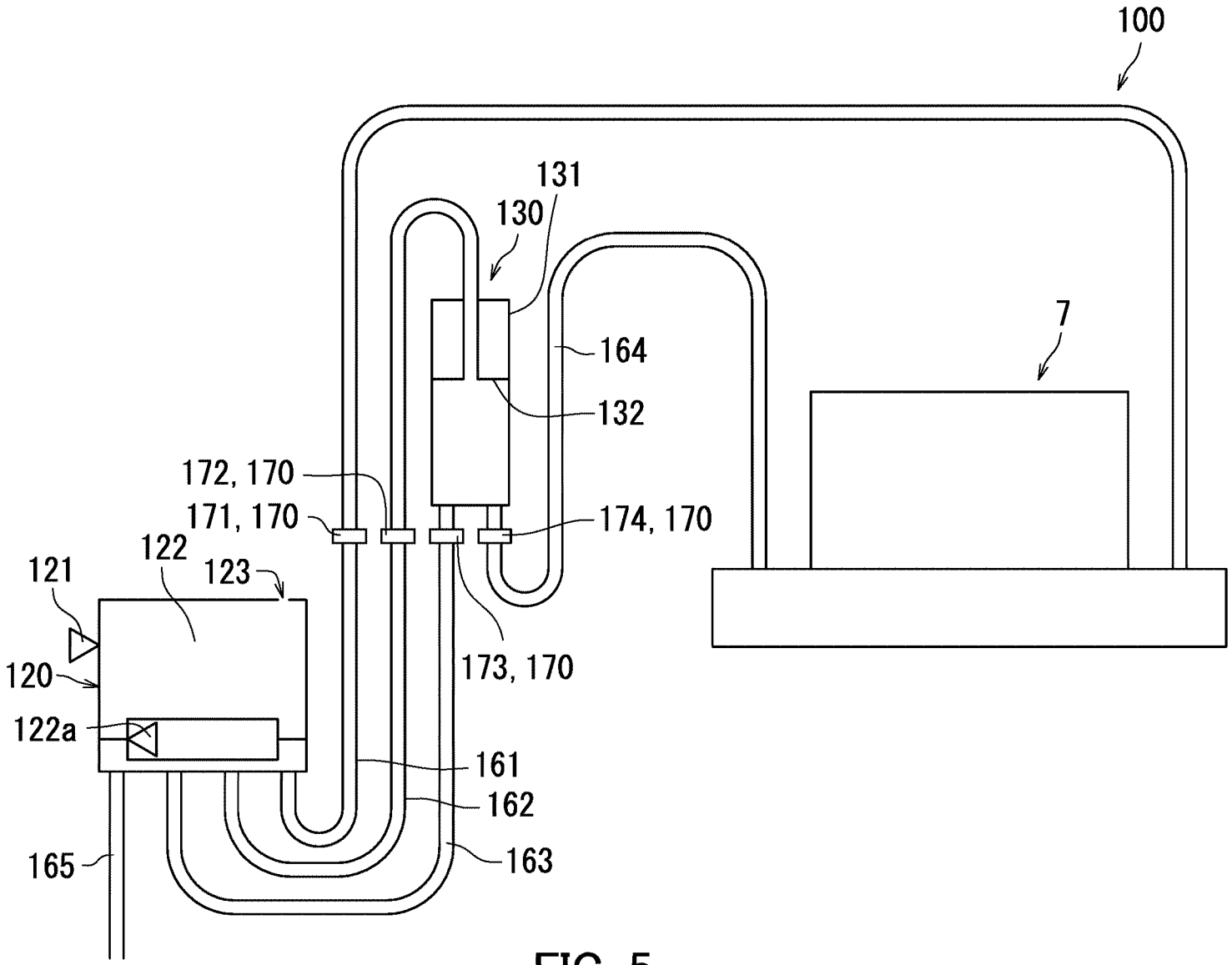
FIG. 5 is a diagram in which the piston of the syringe pump has been moved toward a cap portion.

The following describes a detection operation performed by the controller 9 to detect a communication fault in the ink supplying device 100 with reference to FIGS. 3, 4, 5, and 6. The detection operation is for example performed when the inkjet recording apparatus 1 including the ink supplying device 100 is shipped. FIG. 4 is a diagram in which the piston 132 of the syringe pump 130 has been moved toward the base portion. In FIG. 4, the detector 121 of the sub tank 120 has detected ink. FIG. 5 is a diagram in which the piston 132 of the syringe pump 130 has been moved toward the cap portion. In FIG. 5, the detector 121 of the sub tank 120 is not detecting ink. During the detection operation, the supply of ink from the ink tank 110 to the sub tank 120 is stopped.

Figure 6:
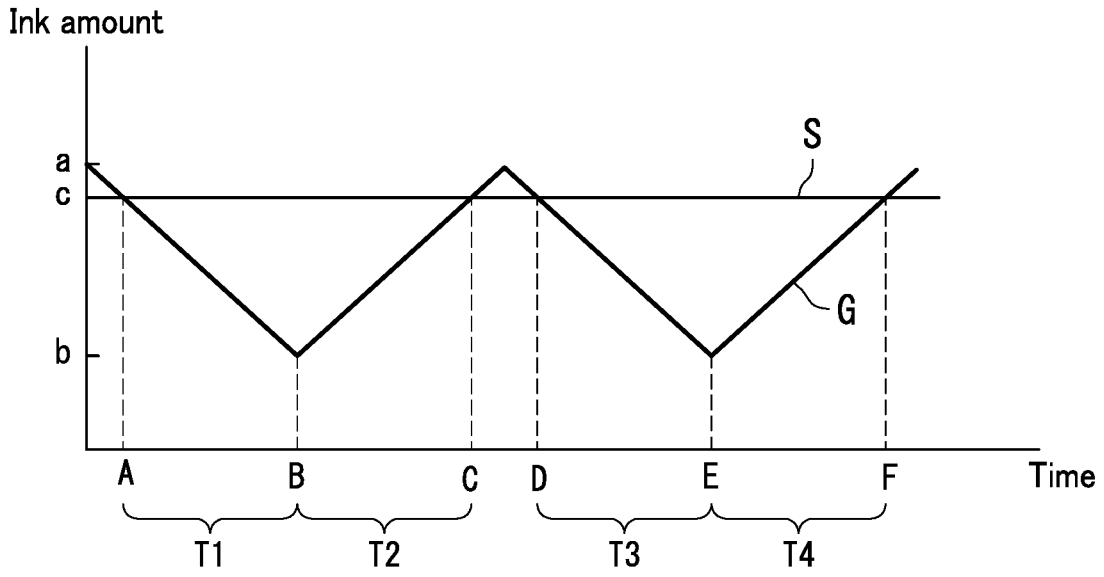
FIG. 6 is a diagram illustrating a change in an amount of ink inside a sub tank.

FIG. 6 is a diagram illustrating a change in an amount of ink inside the sub tank 120. The vertical axis of the graph illustrated in FIG. 6 indicates the amount of ink. The horizontal axis of the graph illustrated in FIG. 6 indicates time. An ink amount a and an ink amount b indicated by the vertical axis indicate the amount of ink inside the sub tank 120. The ink amount a is a value indicating the amount of ink before the syringe pump 130 moves ink from the sub tank 120 into the cylinder 131. The ink amount b is a value indicating the amount of ink after the syringe pump 130 has moved ink from the sub tank 120 into the cylinder 131. A polygonal line G indicates change in the amount of ink inside the sub tank 120. A straight line S indicates an amount of ink capable of being detected by the detector 121.

A time A, a time B, a time C, a time D, a time E, and a time F indicated by the horizontal axis are times at which specific ink amounts are reached. The time A is a time at which the amount of ink inside the sub tank 120 drops to an ink amount c. The time B is a time at which the amount of ink in the sub tank 120 reaches the ink amount b. The time C is a time at which the amount of ink inside the sub tank 120 reaches the ink amount c. The time D is a time at which the amount of ink inside the sub tank 120 drops to the ink amount c. The time E is a time at which the amount of ink inside the sub tank 120 reaches the ink amount b. The time F is a time at which the amount of ink inside the sub tank 120 reaches the ink amount c.

The time A and the time D are times at which the detector 121 switches from ON to OFF. Specifically, the time A and the time D are times at which the detector 121 has gone from detecting ink inside the sub tank 120 to not detecting ink inside the sub tank 120. The time C and the time F are times at which the detector 121 switches from OFF to ON. Specifically, the time C and the time F are times at which the detector 121 has gone from not detecting ink inside the sub tank 120 to detecting ink inside the sub tank 120. The time B and the time E are times at which the piston 132 of the syringe pump 130 stops moving toward the cap portion. The time B and the time E are also times at which the piston 132 of the syringe pump 130 starts moving toward the base portion.

A period T1 is a period between the time A and the time B. A period T2 is a period between the time B and the time C. A period T3 is a period between the time D and the time E. A period T4 is a period between the time E and the time F. The period T1 and the period T3 are periods starting when the detector 121 does not detect ink and ending when the piston 132 stops moving toward the cap portion. The period T2 and the period T4 are periods starting when the piston 132 starts moving toward the base portion and ending when the detector 121 detects ink. When there is no communication fault in the ink supplying device 100, the period T1, the period T2, the period T3, and the period T4 are equal to each other.

The amount of ink moved from the sub tank 120 to the cylinder 131 in the period T1 is equal to the amount of ink moved from the cylinder 131 to the sub tank 120 in the period T2. The amount of ink moved from the sub tank 120 to the cylinder 131 in the period T1 is equal to the amount of ink moved from the sub tank 120 to the cylinder 131 in the period T3. The amount of ink moved from the sub tank 120 to the cylinder 131 in the period T1 is equal to the amount of ink moved from the cylinder 131 to the sub tank 120 in the period T4. That is, the amount of ink moved in the period T1, the amount of ink moved in the period T2, the amount of ink moved in the period T3, and the amount of ink moved in the period T4 are equal to each other.

When the controller 9 performs the detection operation, for example, the measuring section 91 measures the first and second periods in a state where the sub tank 120 and the cylinder 131 are connected through the second pipe 162 as illustrated in FIG. 4. Specifically, the controller 9 directs the flow channel switching section 170 to close the first pipe 161, the third pipe 163, and the fourth pipe 164, and open the second pipe 162. The controller 9 then directs the syringe pump 130 to move ink a specific number of times between the sub tank 120 and the cylinder 131.

Specifically, the controller 9 causes movement of the piston 132 from the position illustrated in FIG. 4 toward the cap portion. That is, the controller 9 directs the syringe pump 130 to move the piston 132 toward the cap portion. Due to the movement of the piston 132, ink inside the sub tank 120 moves into the cylinder 131 through the second pipe 162. The liquid surface inside the sub tank 120 falls due to ink inside the sub tank 120 moving into the cylinder 131 through the second pipe 162. The magnet 122*a* provided in the float 122 falls beneath the height at which the detector 121 is provided along with the falling liquid surface. The detector 121 switches from ON to OFF due to the falling liquid surface. The measuring section 91 starts measurement when the detector 121 has switched to OFF. The time at which the detector 121 switches to OFF is for example the time A when the amount of ink inside the sub tank 120 drops to the ink amount c illustrated in FIG. 6.

Next, the controller 9 causes the piston 132 to move to the position of the piston 132 illustrated in FIG. 5 and stops the movement of the piston 132. Specifically, the controller 9 directs the syringe pump 130 to stop the movement of the piston 132. The measuring section 91 finishes measurement at the time B when the piston 132 stops moving. The measuring section 91 measures the period T1. The period T1 is a period starting when the detector 121 has switched to OFF and ending when the piston 132 stops moving toward the cap portion. The period T1 measured by the measuring section 91 is stored in the storage 10 as a first period.

Next, the controller 9 causes the piston 132 to move from the position of the piston 132 illustrated in FIG. 5 toward the base portion. Specifically, the controller 9 directs the syringe pump 130 to move the piston 132 toward the base portion. The measuring section 91 starts measurement when the piston 132 has started moving. The time when the piston 132 starts moving is for example the time B when the amount of ink inside the sub tank 120 reaches the ink amount b illustrated in FIG. 6. Due to the movement of the piston 132, ink inside the cylinder 131 moves into the sub tank 120 through the second pipe 162. The liquid surface inside the sub tank 120 rises due to ink inside the cylinder 131 passing through the second pipe 162 and moving into the sub tank 120. The magnet 122*a* provided in the float 122 rises to the height at which the detector 121 is provided along with the rising liquid surface. The detector 121 switches from OFF to ON due to the rising liquid surface. The measuring section 91 finishes measurement when the detector 121 has switched to ON. The time at which the detector 121 switches to ON is for example the time C at which the amount of ink inside the sub tank 120 reaches the ink amount c illustrated in FIG. 6. The measuring section 91 measures the period T2. The period T2 is a period starting when the piston 132 has started moving toward the base portion and ending when the detector 121 switches to ON. The period T2 measured by the measuring section 91 is stored in the storage 10 as a second period.

Next, the controller 9 causes the piston 132 to move to the position of the piston 132 illustrated in FIG. 4 and stops the movement of the piston 132. Specifically, the controller 9 directs the syringe pump 130 to stop the movement of the piston 132.

Next, the controller 9 performs the operation performed in the first and second periods again. The controller 9 directs the syringe pump 130 to move the piston 132 toward the cap portion. Due to the movement of the piston 132, ink inside the sub tank 120 moves into the cylinder 131 through the second pipe 162. The detector 121 switches from ON to OFF due to the movement of ink. The measuring section 91 starts measurement at the time D at which the detector 121 switches to OFF.

Next, the controller 9 directs the syringe pump 130 to stop the movement of the piston 132. The measuring section 91 finishes measurement at the time E at which the piston 132 stops moving. The measuring section 91 measures the period T3. The period T3 is a period starting when the detector 121 has switched to OFF and ending when the piston 132 stops moving toward the cap portion. The period T3 measured by the measuring section 91 is stored in the storage 10 as a first period.

Next, the controller 9 directs the syringe pump 130 to move the piston 132 toward the base portion. The measuring section 91 starts measurement at the time E when the piston 132 starts moving. Due to the movement of the piston 132, ink inside the cylinder 131 moves into the sub tank 120 through the second pipe 162. The detector 121 switches from OFF to ON due to the movement of ink. The measuring section 91 finishes measurement at the time F when the detector 121 switches to ON. The measuring section 91 measures the period T4. The period T4 is a period starting when the piston 132 has started moving toward the base portion and ending when the detector 121 switches to ON. The period T4 measured by the measuring section 91 is stored in the storage 10 as a second period.

Next, the controller 9 directs the syringe pump 130 to stop the movement of the piston 132.

Next, the determining section 92 determines whether or not the first and second periods measured by the measuring section 91 are equal. When the first and second periods are equal, a communication fault has not occurred in the ink supplying device 100. When the first and second periods are not equal, a communication fault has occurred in the ink supplying device 100. That is, the first open-close member 171, the third open-close member 173, and the fourth open-close member 174 are unable to push closed the first pipe 161, the third pipe 163, or the fourth pipe 164. As a result, a communication fault in the ink supplying device 100 can be discovered through the detection operation.

The detection operation performed by the controller 9 can also detect a communication fault in the ink supplying device 100 using for example the second pipe 162 and the third pipe 163. Specifically, the controller 9 directs the flow channel switching section 170 to close the first pipe 161, the third pipe 163, and the fourth pipe 164, and open the second pipe 162.

The controller 9 directs the syringe pump 130 to move the piston 132 toward the cap portion. Due to the movement of the piston 132, ink inside the sub tank 120 moves into the cylinder 131 through the second pipe 162. Due to the movement of ink, the detector 121 switches from ON to OFF. The measuring section 91 starts measurement at the time A when the detector 121 switches to OFF.

Next, the controller 9 directs the syringe pump 130 to stop the movement of the piston 132. The measuring section 91 finishes measurement at the time B when the piston 132 stops moving. The measuring section 91 measures the period T1. The period T1 is a period starting when the detector 121 has switched to OFF and ending when the piston 132 stops moving toward the cap portion. The period T1 measured by the measuring section 91 is stored in the storage 10 as a first period.

Next, the controller 9 directs the flow channel switching section 170 to close the first pipe 161, the second pipe 162, and the fourth pipe 164, and open the third pipe 163.

Next, the controller 9 directs the syringe pump 130 to move the piston 132 toward the base portion. The measuring section 91 starts measurement at the time B when the piston 132 starts moving. Due to the movement of the piston 132, ink inside the cylinder 131 moves into the sub tank 120 through the third pipe 163. Due to the movement of ink, the detector 121 switches from OFF to ON. The measuring section 91 finishes measurement at the time C when the detector 121 switches to ON. The measuring section 91 measures the period T2. The period T2 is a period starting when the piston 132 has started moving toward the base portion and ending when the detector 121 switches to ON. The period T2 measured by the measuring section 91 is stored in the storage 10 as a second period.

Next, the controller 9 directs the syringe pump 130 to stop the movement of the piston 132. Note that the controller 9 may perform the operation performed in the first and second periods again and direct the measuring section 91 to measure the first and second periods.

Next, the determining section 92 determines whether or not the first and second periods measured by the measuring section 91 are equal. When the first and second periods are equal, a communication fault has not occurred in the ink supplying device 100. When the first and second periods are not equal, a communication fault has occurred in the ink supplying device 100. That is, the first open-close member 171, the second open-close member 172, the third open-close member 173, and the fourth open-close member 174 are unable to push closed the first pipe 161, the second pipe 162, the third pipe 163, or the fourth pipe 164. As a result, a communication fault in the ink supplying device 100 can be detected through the detection operation.

Note that although an example is described in which the detection operation is performed twice as illustrated in FIG. 6, the detection operation may be performed more than twice. It may not be possible to detect a communication fault in the ink supplying device 100 by performing the detection operation only once when leakage of ink is small. As such, the leakage of ink gradually increases as the detection operation is repeated multiple times, and the controller 9 can detect a communication fault in the ink supplying device 100. As a result, the controller 9 can detect a communication fault in the ink supplying device 100 even when the leakage of ink is small.

Figure 7:
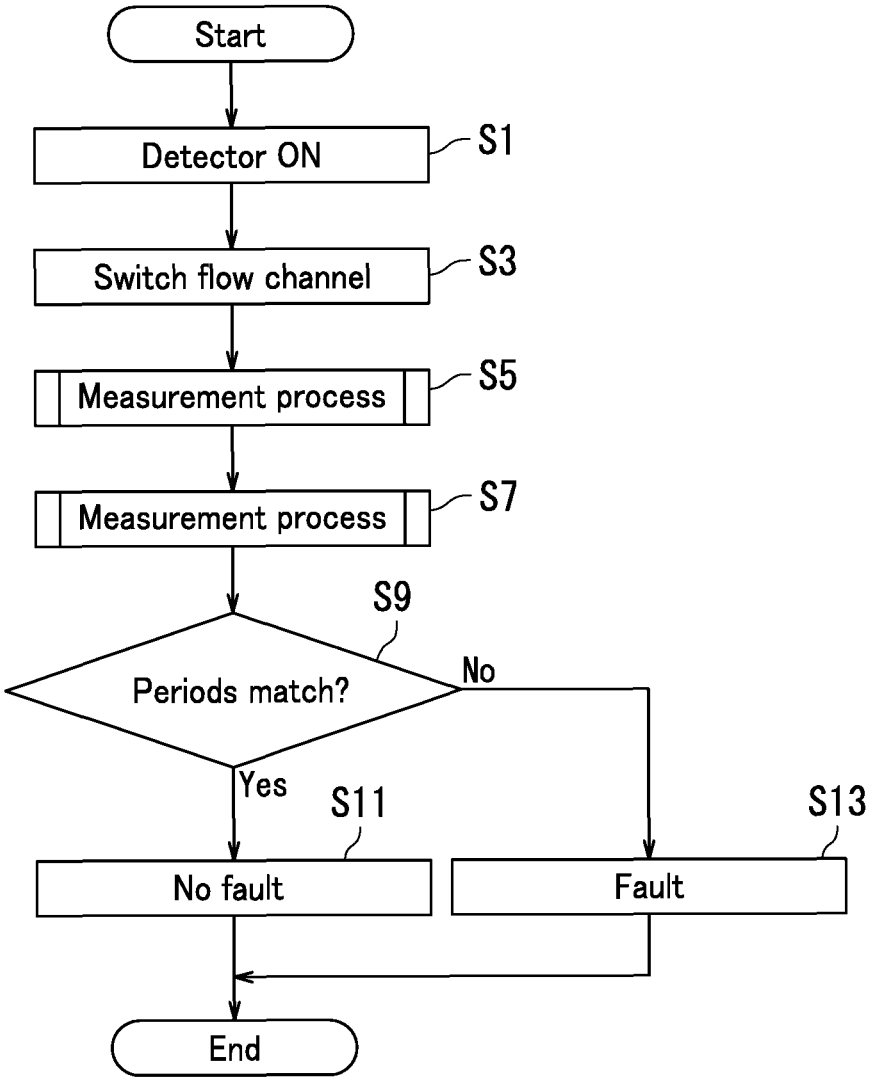
FIG. 7 is a flowchart depicting a process of detection operation performed by a controller.
Figure 8:
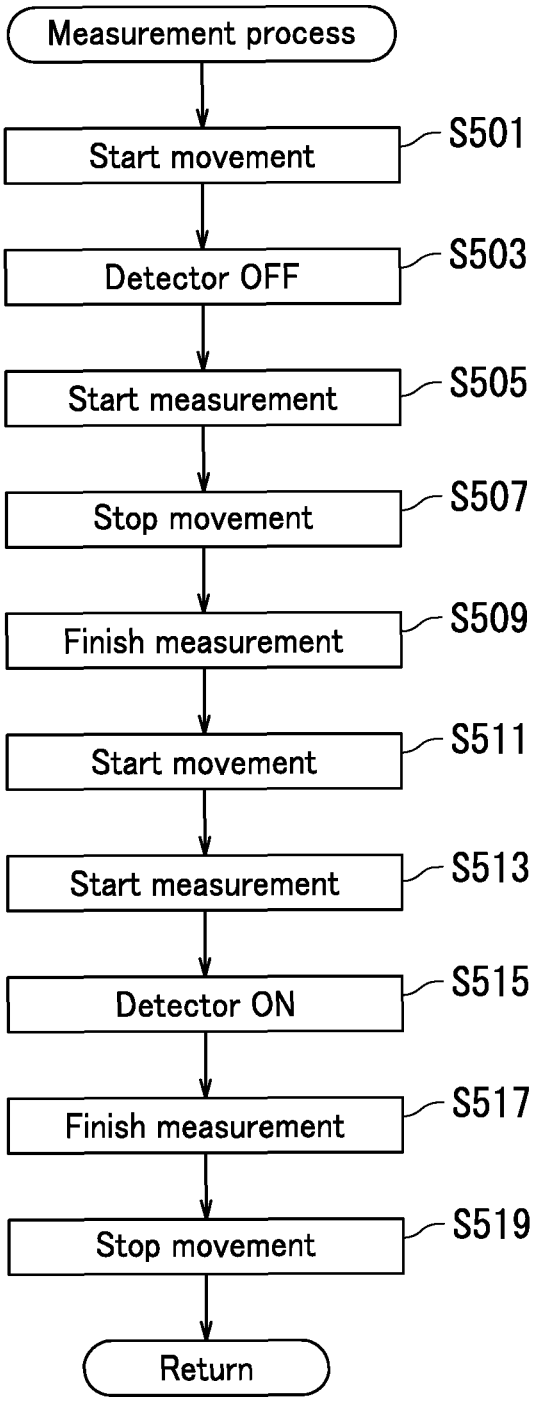
FIG. 8 is a flowchart specifically depicting a measurement process.

The following describes a flow of the process of the detection operation performed by the controller 9 with reference to FIGS. 6, 7, and 8. FIG. 7 is a flowchart depicting the process of the detection operation performed by the controller 9. FIG. 8 is a flowchart specifically depicting the measurement process. As illustrated in FIG. 7, the process performed by the controller 9 includes Steps S1 to S13.

In Step S1, the controller 9 directs the detector 121 to switch to ON. Specifically, the detector 121 detects ink inside the sub tank 120. That is, ink is present in the sub tank 120. The process proceeds to Step S3.

In Step S3, the controller 9 directs the flow channel switching section 170 to switch the flow channel. Specifically, the controller 9 opens only one of the first pipe 161, the second pipe 162, the third pipe 163, and the fourth pipe 164, and closes the remaining three pipes. The process proceeds to Step S5.

In Step S5, the controller 9 performs the measurement process. The measuring section 91 measures the first and second periods. The measurement process is later described with reference to FIG. 8. The process proceeds to Step S7.

In Step S7, the controller 9 performs the measurement process. The measuring section 91 measures the first and second periods. The process proceeds to Step S9.

In Step S9, the determining section 92 determines whether or not the first and second periods are equal. When the first and second periods are not equal (No in Step S9), the process proceeds to Step S13. When the first and second periods are equal (Yes in Step S9), the process proceeds to Step S11.

In Step S11, the controller 9 determines that there is no communication fault in the ink supplying device 100. The process ends.

In Step S13, the controller 9 determines that there is a communication fault in the ink supplying device 100. The process ends.

The following describes the measurement process in Step S5 with reference to FIGS. 6 and 8. The measurement process is a process by which the measuring section 91 measures the first and second periods. As illustrated in FIG. 8, the measurement process performed by the controller 9 includes Steps S501 to S519.

In Step 501, the controller 9 directs the syringe pump 130 to move the piston 132 toward the cap portion. The process proceeds to Step S503.

In Step S503, the controller 9 acquires a signal indicating that the detector 121 has switched from ON to OFF. That is, the detector 121 does not detect ink inside the sub tank 120. The process proceeds to Step S505.

In Step S505, the measuring section 91 starts measurement at the time A when the detector 121 switches to OFF. The process proceeds to Step S507.

In Step S507, the controller 9 directs the syringe pump 130 to stop moving the piston 132 toward the cap portion. The process proceeds to Step S509.

In Step S509, the measuring section 91 finishes measurement at the time B when the piston 132 stops moving. The period T1 measured by the measuring section 91 is stored in the storage 10 as a first period. The process proceeds to Step S511.

In Step S511, the controller 9 directs the syringe pump 130 to move the piston 132 toward the base portion. The process proceeds to Step S513.

In Step S513, the measuring section 91 starts measurement at the time B when the piston 132 starts moving. The process proceeds to Step S513.

In Step S515, the controller 9 acquires a signal indicating that the detector 121 has switched from OFF to ON. Specifically, the detector 121 detects ink inside the sub tank 120. The process proceeds to Step S517.

In Step S517, the measuring section 91 finishes measurement at the time C when the detector 121 switches to ON. The period T2 measured by the measuring section 91 is stored in the storage 10 as a second period. The process proceeds to Step S519.

In Step S519, the controller 9 directs the syringe pump 130 to stop moving the piston 132 toward the base portion. The process returns to Step S9.

The measurement process in Step S7 is a process by which the measuring section 91 measures the first and second periods. The measurement process in Step S7 is similar in content to the measurement process in Step S5, and description thereof is therefore omitted.

The determining section 92 can determine whether or not an open-close member is pushing on a pipe such that ink does not leak by determining whether or not the first and second periods measured by the measuring section 91 are equal.

The embodiment of the present disclosure is described above with reference to the drawings (FIGS. 1 to 8). However, the present disclosure is not limited to the above embodiment and may be implemented in various manners within a scope not departing from the gist thereof. Various disclosures may also be created by appropriately combining elements of configuration in a plurality of embodiments. For example, a number of the elements of configuration may be removed from the entirety of elements of configuration disclosed in the embodiment. Furthermore, elements of configuration may be appropriately combined across varying embodiments. The drawings illustrate the main elements of configuration schematically to facilitate understanding thereof. Aspects of the elements of configuration illustrated in the drawings, such as thickness, length, number, and spacing thereof, may differ in practice for the sake of convenience for drawing preparation. Aspects of the elements of configuration illustrated in the above embodiment, such as speed, material, shape, and dimension thereof, are merely examples and are not particularly limited. The elements of configuration may be variously altered within a scope not substantially departing from the configuration of the present disclosure.

What is claimed is:

1. An ink supplying device comprising:

a first reservoir configured to store ink;

a second reservoir configured to store the ink;

a pump configured to move the ink between the first reservoir and the second reservoir;

a detector provided on the first reservoir and configured to detect the ink in the first reservoir;

a measuring section configured to measure a first period and a second period; and a determining section configured to determine whether or not the first period and the second period are equal, wherein the first period is a period starting when the detector does not detect the ink and ending when the pump has moved the ink from the first reservoir to the second reservoir, and the second period is a period starting when the pump starts moving the ink from the second reservoir to the first reservoir and ending when the detector detects the ink.

2. The ink supplying device according to claim 1, wherein the pump moves the ink between the first reservoir and the second reservoir a specific number of times.

3. The ink supplying device according to claim 1, further comprising a plurality of pipes, wherein the pump moves the ink between the first reservoir and the second reservoir through at least one of the pipes.

4. The ink supplying device according to claim 1, further comprising a flow channel switching section, wherein the flow channel switching section includes an open-close member configured to open and close a pipe.

5. An inkjet recording apparatus comprising the ink supplying device according to claim 1.

6. A communication fault determination method to be performed by an ink supplying device, the ink supplying device including:

a pump configured to move ink between a first reservoir and a second reservoir; and a detector provided on the first reservoir and configured to detect the ink in the first reservoir, the communication failure determination method comprising:

measuring a first period and a second period; and determining whether or not the first period and the second period are equal, wherein the first period is a period starting when the detector does not detect the ink and ending when the pump has moved the ink from the first reservoir to the second reservoir, and the second period is a period starting when the pump starts moving the ink from the second reservoir to the first reservoir and ending when the detector detects the ink.

* * * * *